United States Patent [19]

Quay et al.

[11] Patent Number: 4,510,773

[45] Date of Patent: Apr. 16, 1985

[54] FIBER TRANSFER SYSTEM FOR SLIVER HIGH PILE FABRIC CIRCULAR KNITTING MACHINES

[75] Inventors: Earl R. Quay; Alan L. Tilson, both of Orangeburg, S.C.

[73] Assignee: Mayer, Rothkopf Industries, Inc., Orangeburg, S.C.

[21] Appl. No.: 615,801

[22] Filed: May 31, 1984

Related U.S. Application Data

[63] Continuation-in-part of Ser. No. 539,802, Oct. 7, 1983, abandoned.

[51] Int. Cl.[3] ..... D01G 15/40; D01G 15/84; D04B 9/12

[52] U.S. Cl. ..... 66/9 B; 19/105; 19/106 R; 19/288

[58] Field of Search ..... 66/9 B; 19/105, 106 R, 19/288

[56] References Cited

U.S. PATENT DOCUMENTS

| | | | |
|---|---|---|---|
| 1,114,414 | 10/1914 | Tauber | 66/9 B |
| 3,005,239 | 10/1961 | Worley | 19/106 R |
| 3,010,297 | 11/1961 | Hill | 66/9 B |
| 3,095,614 | 7/1963 | Moore | 66/9 B |
| 3,299,672 | 1/1967 | Schmidt | 66/9 B |
| 3,427,829 | 2/1969 | Wiesinger | 66/9 B |
| 3,516,265 | 6/1970 | Collez | 66/9 B |
| 3,896,636 | 7/1975 | Thore | 66/9 B |
| 3,928,986 | 12/1975 | Thore | 66/9 B |
| 3,968,662 | 7/1976 | Kunak et al. | 66/9 B |
| 4,408,370 | 10/1983 | Quay | 19/105 |

*Primary Examiner*—Louis K. Rimrodt

*Attorney, Agent, or Firm*—Harding, Earley, Follmer & Frailey

[57] ABSTRACT

A fiber transfer system for feeding fibers to the needles of a sliver high pile fabric circular knitting machine, in which the width of the fiber transfer path from the feed rolls to the needle line at the doffer is constant. Adjustable sliver entrance guides accurately direct the roving into the feed rolls and determine the location and width of the fiber transfer path. A continuous film of fibers of selected width and uniform density is transferred from the feed rolls via the main cylinder and doffer to the knitting machine needles. The main cylinder preferably is of a greater axial width than the doffer. It is covered by a narrow, elongated strip of wire-covered clothing wrapped helically around its periphery. The doffer is enveloped by straight wound card clothing, preferably constituted of a rectangular segment of wire-covered clothing having its opposite ends abutting on the doffer. The invention maximizes utilization of the fiber transfer area available to the knitting machine. It enables the use of wider fiber transfer paths and/or the provision of an increased number of fiber transfer units about the circumference of the machine.

19 Claims, 5 Drawing Figures

FIBER TRANSFER SYSTEM FOR SLIVER HIGH PILE FABRIC CIRCULAR KNITTING MACHINES

RELATED APPLICATION

This application is a continuation-in-part of Earl R. Quay and Alan L. Tilson U.S. patent application Ser. No. 539,802 filed Oct. 7, 1983 and entitled "Fiber Transfer System for Sliver High Pile Fabric Knitting Machines", now abandoned.

FIELD OF THE INVENTION

The present invention concerns the knitting of sliver high pile fabrics on circular knitting machines such as the type illustrated in Tauber U.S. Pat. No. 1,114,414, Hill U.S. Pat. No. 3,010,297, Schmidt U.S. Pat. No. 3,299,672, Wiesinger U.S. Pat. No. 3,427,829 and Thore U.S. Pat. No. 3,928,986. High pile fabric knitting machines generally are rotary knitting machines provided with a plurality of carding heads, constituting fiber transfer units, for feeding sliver fibers to the knitting needles. Usually, the knitting needles are mounted independently in a cylinder, which is rotatable relative to the several carding heads disposed at circumferentially spaced locations around the cylinder.

DESCRIPTION OF THE PRIOR ART

The carding heads for supplying sliver fibers to the needles of high pile fabric knitting machines are constituted of sliver feeding elements, usually at least one pair of rotatable sliver feed rolls generally having either wire-covered or fluted peripheries, a rotatable wire-covered main cylinder and a rotatable wire-covered doffer. The sliver feed rolls draw the roving or sliver in rope form from a source of supply, and deliver the fibers, in sheet or film form, to the main cylinder. The latter, acting as a transfer medium, conveys the layer of sliver fibers to the doffer which, in turn, feeds the fibers to the needles of the knitting machine. In order to properly align or parallelize the fibers during their delivery to the needles, the main cylinder is caused to rotate faster than the sliver feed rolls, and the doffer is caused to rotate faster than the main cylinder.

In clothing the doffer and main cylinder, it has been the practice for decades to wrap an elongated, narrow strip of wire-covered card clothing helically about the peripheral surfaces of those cylindrical elements. Each of the two axially spaced ends of the helical wound strip is secured to the doffer or to the main cylinder by fastening means, such as a threaded bolt passing through the rim area and being secured thereto by a threaded nut.

Because of the inherent nature of a helix, the axially spaced end or edge portions of the doffer and main cylinder, where the ends of the helically wound strips of card clothing are secured, have voids or open areas. Such gaps, lacking wire coverage, cannot transfer fibers during sliver knitting. Hence, the fiber transfer paths of both the doffer and the main cylinder, as presently used, necessarily are of a significantly smaller width than the full axial widths of those two elements.

As far as the main cylinder is concerned, this diminution in the width of the fiber transfer area creates no serious problem. However, with respect to the doffer, such shortcoming means that far less than the full fiber transfer area available to a sliver high pile fabric circular knitting machine is being used. Accordingly, the productive capacity of the machine is not fully utilized.

Because of the bare or wireless peripheral areas at the edge portions of doffers and main cylinders presently in use. those elements usually are of equal axial widths. In some instances, the doffers are of a greater width than their accompanying main cylinders. In view of the pie-shaped spatial segments disposed circumferentially about the needle cylinder of the knitting machine, the utilization of doffers having axial widths equal to, or greater than, that of their main cylinders limits the number of fiber transfer units which can be utilized with a standard circular knitting machine.

Moreover, due to the helical winding of the doffer card clothing, non-uniformity in the distribution of fibers on the doffer usually occurs. There are two reasons for this. First, there are the voids aforesaid in wire coverage on the doffer adjacent the edge areas where the ends of the helically wound card clothing are fastened. Second, there is a tendency for fibers on the helically wound doffer clothing to migrate toward the helical ends in those edge areas. As a result, when the needles rake the doffer wires they encounter both the wireless gaps on the doffer and a non-uniformity in fiber density on the wires at the ends of the helix, thereby causing non-uniformity in the pile of the fabric being knit.

In the past, at least one attempt has been made to solve the problems aforesaid in fiber transfer and feeding in sliver knitting by providing a "full width" doffer, i.e. a doffer whereof the width of its fiber transfer area is uniform and devoid of wireless gaps. Such an arrangement is illustrated by Moore U.S. Pat. No. 3,095,614, where the doffer is completely covered by a plurality of separate, inclined, coterminus strips of card clothing. However, the doffer of that patent suffers from the quite substantial disability that its full width doffer is of a greater axial width than its main cylinder. Also, the provision and application to a doffer of wire-covered card clothing in the form of inclined plural strips appears to be a difficult, complex, expensive and time-consuming operation. And, because of the large number of individual strips, the Moore arrangement is prone to the presence of undesirable gaps or separations between adjacent strips. So far as is known, the fiber transfer device of the Moore patent never has gone into commercial use.

This invention, utilizing a full width doffer in a new and improved manner with a conventional main cylinder, overcome the drawbacks inherent in the fiber transfer units presently utilized in sliver knitting. For the first time, it enables a sliver high pile fabric circular knitting machine to employ productively substantially the whole of the fiber transfer area available to it.

SUMMARY OF THE INVENTION

The primary object of this invention is to provide a new and improved fiber transfer system for maximizing use of the total of the fiber transfer capacity available to a sliver high pile fabric circular knitting machine.

A further object of the invention is to provide a new and improved fiber transfer and feeding unit for use with sliver high pile fabric knitting machines which permits the utilization of an increased number of such units with the knitting machine, thereby increasing the productive capacity of the machine.

A further object is to provide such a fiber transfer and feeding unit having a full width doffer which has a shorter axial width than its accompanying main cylinder, thereby permitting an increased number of such fiber units to be disposed circumferentially about the needle cylinder of a circular knitting machine.

A further object is to provide a new and improved fiber transfer and feeding unit for use with sliver knitting machines which permits the utilization of a wider fiber transfer path to the knitting machine needles.

A further object is to provide such a fiber transfer and feeding unit which permits the utilization of an increased number of such units with the knitting machine while, at the same time, increasing the width of the fiber transfer path of each unit.

A further object is to provide a new and improved fiber transfer and feeding unit for use with sliver knitting machines which utilizes a novel roving guide means for accurately guiding the sliver to the feed rolls, whereby the fiber transfer path to the knitting machine needles may be selectively located and controlled.

A further object is to provide a new and improved fiber transfer and feeding unit having a full width doffer whereof the width of its fiber transfer area is substantially equal to the width of the fiber transfer area of its accompanying conventional main cylinder having wire-covered clothing wound spirally thereon.

A further object is to provide a new and improved fiber transfer system for sliver high pile fabric circular knitting machines whereby the width and location of the fiber transfer path and the thickness, density and uniformity of the layer of fibers being transferred may be selectively controlled to produce knitted high pile fabrics having pile fiber densities of substantially enhanced uniformity.

Other objects and advantages of this invention will be readily apparent from the accompanying detailed description of the preferred embodiment thereof, which is illustrated in the views of the accompanying drawing.

DESCRIPTION OF THE INVENTION

Figure 2:
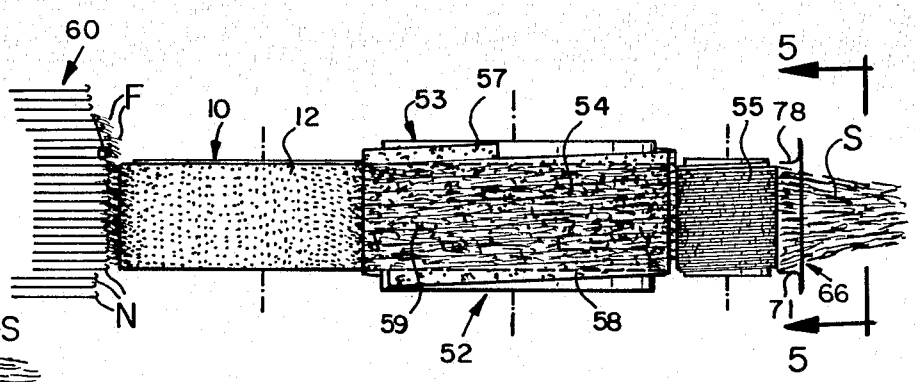
FIG. 2 is a schematic linear development in top plan of the carding head looking in the direction of the angled arrows 2—2 of FIG. 1, illustrating the transfer and feeding of fibers to the knitting machine needles.
Figure 1:
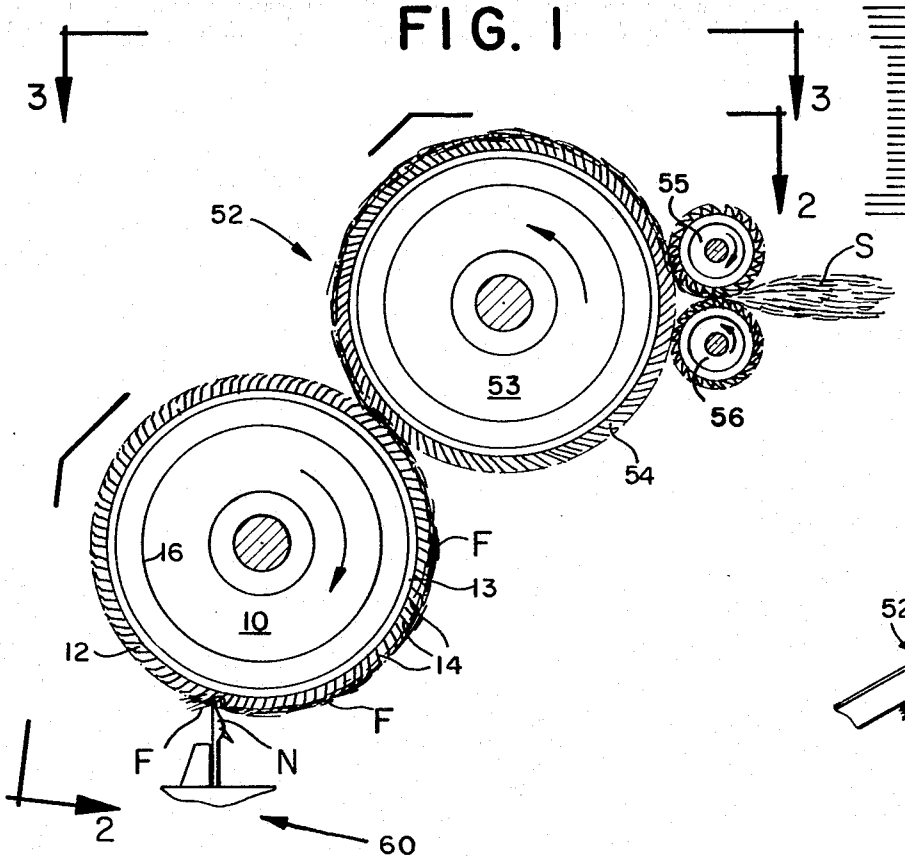
FIG. 1 is a fragmentary, schematic view in side elevation of a carding head for a sliver high pile fabric knitting machine incorporating a preferred embodiment of this invention.

Referring first to FIGS. 1 and 2 of the drawing, where a preferred embodiment of this invention is disclosed, there is illustrated a fiber transfer and feeding unit 52, often referred to as a "carding head", for processing sliver fibers S and transferring and feeding them to the needles N of a conventional sliver high pile fabric circular knitting machine 60 having a standard needle cylinder 24 inches in diameter. The fiber transfer and feeding unit 52 includes a rotatable doffer 10 enveloped by wire-covered card clothing 12, a rotatable main cylinder 53 enveloped by wire-covered card clothing 54 and at least one pair of mating sliver feed rolls 55, 56 for feeding the sliver or roving S to the main cylinder 53 in the usual manner. The feed rolls 55, 56, main clyinder 53 and doffer 10 are operative to advance the fibers of the sliver S at progressively increasing rates of speed to the needles N of the knitting machine 60 while combing and parallelizing the fibers into a thin layer, sheet or film of aligned fibers F on the wire periphery of the doffer 10. Selected needles N, which may comprise all or less than all of the complement of needles of the circular knitting machine 60, rake fibers F from the doffer as the circle of needles rotates relative thereto.

The main cylinder 53 is of conventional construction. Its card clothing 54 has the usual wire nogs and is constituted of an elongated, narrow, wire-covered strip wound helically on the periphery of the main cylinder 53 to offset its wires in the usual manner. Thus, the axially spaced side or edge areas 57, 58 (FIG. 2) of the main cylinder 53, where the opposite ends of the helically wound strip of card clothing 54 are secured, have the usual voids or open spaces and cannot be utilized for the proper transmission of fibers from the feed rolls 55, 56 to the doffer 10. In a conventional main cylinder 53 having a diameter of 6 inches and an axial width of 2 ½ inches, the fiber transfer area 59, intermediate the axially spaced edge areas 57, 58, usually is on the order of 2 inches in width.

The card clothing 12 of the doffer 10 also has the usual nog construction. However, it is not in the form of the conventional helically wound strip. Rather, the clothing 12 is "straight wound" or "straight wrapped" on the doffer 10, whereby its individual wires 14 are aligned axially across the doffer periphery and each nog group of wires is aligned circumferentially around it. This provides a "full population" of doffer wires, i.e. a "full width" or "full face" doffer whereof its fiber transfer area is of constant width and is entirely and uniformly covered by wire.

To achieve this desideratum, it is preferred that the wire-covered card clothing 12 of the doffer 10 be constituted of an integral or one piece, generally rectangular segment of uniform width which is free of voids and other defects. When such segment is affixed to the doffer, its longitudinally spaced ends are disposed in tight abutting relationship to each other transversely across the periphery of the doffer. In such arrangement, the width of the doffer wire clothing through which the needles N pass to rake fibers is constant, and is devoid of open areas.

If desired, the entire peripheral surface of the doffer 10 may be covered with the rectangular segment of card clothing 12, as illustrated in the drawing, whereby the width of the fiber transfer area of the doffer is equal to its axial width. In such case, the width of the doffer 10 may be reduced so that it is equal to, or substantially equal to, the width of the fiber transfer area 59 of the main cylinder 53. According to the arrangement illustrated in FIGS. 1 and 2, a doffer 10 having an axial width of 2 inches and fully covered by card clothing 12 may be utilized with a main cylinder 53 which is 2 ½ inches in width and has a fiber transfer area 59 which is 2 inches wide.

Essentially, the invention combines a conventional helically wound main cylinder with a non-helically wound doffer, in which their respective fiber transfer areas are accurately aligned and are equal, or substantially equal, in width.

Figure 3:
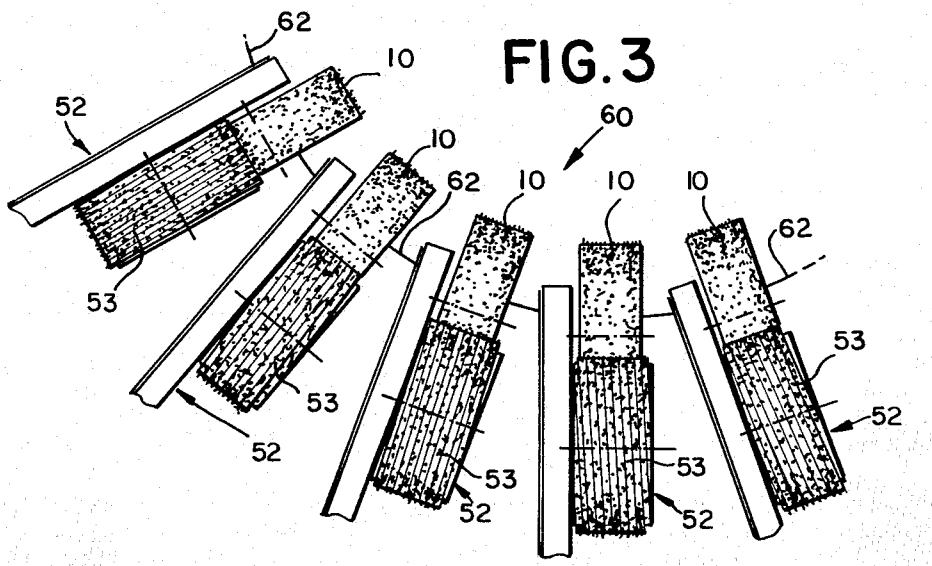
FIG. 3 is a fragmentary, schematic view in top plan of the knitting head of a multi-feed sliver high pile fabric circular knitting machine utilizing carding heads of the invention.

An important advantage achieved by this invention is illustrated schematically in FIG. 3, where a plurality of circumferentially spaced fiber transfer and feeding units or "cards" 52 are disposed in fiber feeding relationship relative to the 24 inch needle cylinder 62 of a circular knitting machine 60. As shown, because the doffers 10 of each of the units 52 have been reduced significantly in axial width, a smaller pie-shaped segment of space is required to accommodate each such unit relative to the needle cylinder 62. Accordingly, an increased number of units 52 may be installed on the knitting machine 60, thereby maximizing use of the total fiber transfer capacity available to the machine. By more efficiently using the fiber handling capacity of the machine 60, by the provision of additional fiber feeding units 52, production of the knitting machine is significantly increased.

The invention enables maximum utilization of the fiber transfer capacity available to the knitting machine 60 even when the number of fiber carding units 52 is not increased. Because of the combination of a helically wound main cylinder 53 with a straight wound doffer 10, the fiber transfer path through the carding unit 52 may be substantially widened. In a 12 feed sliver high pile fabric circular knitting machine, the fiber transfer paths of the conventional fiber transfer and feeding units are on the order of 44 mm wide. By reason of this invention, the widths of the fiber transfer paths in such a machine may be increased to 60 mm.

Further, the invention permits increasing the number of carding units 52 utilized with the knitting machine 60 while, at the same time, increasing the width of the fiber transfer paths of such units. For example, in the practice of the invention, it is possible to provide the knitting machine 60 with a total of 18 of the new carding units 52, each having a fiber transfer path on the order of 50 mm in width.

Increasing the width of the fiber path through the fiber feeding unit 52 provides significant advantages in sliver knitting. It reduces fiber congestion at the location where the feed rolls 55, 56 transfer fibers to the main cylinder 53, thereby permitting a more uniform release of fibers. It enables a thinner, wider and more uniform film or layer of fibers to be delivered to the doffer 10, whereby a more uniform and consistent feeding of fibers to the knitting machine needles N is achieved. This results in significantly increased fiber uniformity in the pile of the fabric being knit and substantially reduces the problem of needle breakage, which long has plagued the sliver knitting art.

It is important, in the practice of this invention, that the card clothing 54 of the main cylinder 53 be wound helically, so that its nogs of wires are helically arranged or offset about its periphery, and that the main cylinder be rotated at a surface speed greater than that of the sliver feed rolls 55, 56. This ensures that the fibers of the sliver S, upon passing from the feed rolls 55, 56 to the main cylinder 53, are properly combed, i.e. drawn out and flattened into sheet form, with the individual fibers F generally aligned or parallelized in the direction of fiber flow. Similarly, the doffer 10, in the practice of this invention, is caused to rotate at a surface speed greater than that of the main cylinder 53. This ensures not only that the fibers F are transferred properly from the wire periphery 54 of the main cylinder 53 to the wire periphery 12 of the doffer 10, but it enables the wires 14 of the doffer to function to draw the sheet or layer of fibers F into a thinner film of aligned or parallelized fibers as they are transferred to the needles N.

Figure 4:
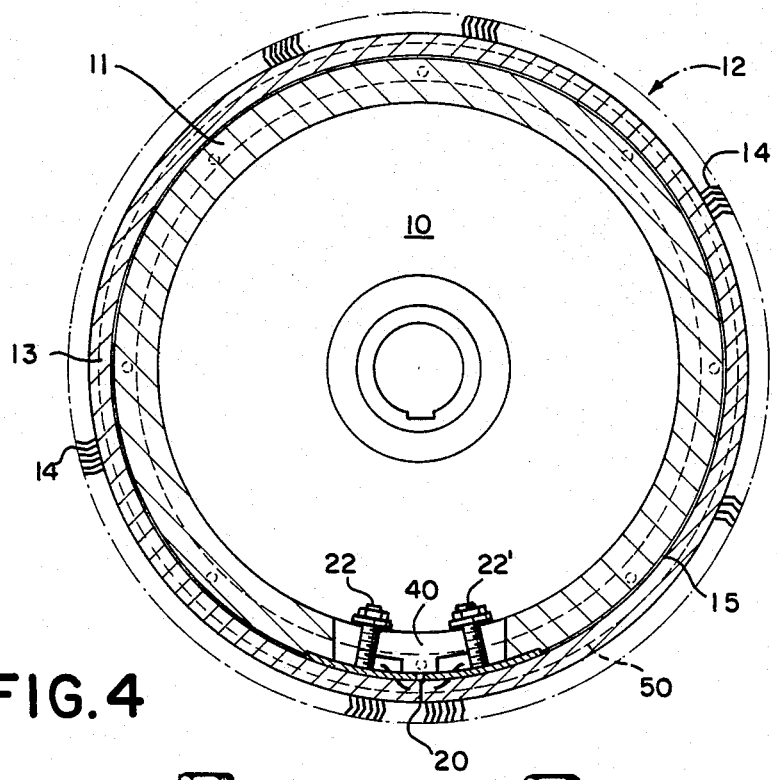
FIG. 4 is a sectional view in side elevation of a preferred doffer utilized in the invention.

The preferred manner for attaching the doffer card clothing 12 to the doffer 10 is illustrated in FIG. 4, and is the subject of Earl R. Quay pending U.S. patent application Ser. No. 538,142 filed Oct. 3, 1983 and entitled "Wire-Covered Doffer for Sliver High Pile Fabric Knitting Machines". The doffer 10 is composed of the usual cast metal doffer roll 11 surrounded by the wire-covered card clothing 12 composed of a backing 13 from which protrude the plurality of doffer wires 14. The doffer wires 14 may be constituted of wire of the self-cleaning type described in Quay U.S. Pat. No. 4,408,371. A layer of adhesive tape 15 preferably is interposed between the card clothing 12 and the periphery of the doffer roll 11 to provide a covering to protect the periphery from marring by the inner portions of the wires 14.

When the rectangular segment of card clothing 12 is wrapped around the periphery of the doffer roll 11, as illustrated in FIG. 4, it is tensioned slightly and its longitudinally spaced ends are pressed together in abutting relationship to provide a tight transverse joint or closure 20 devoid of gaps or openings. The rectangular segment of card clothing 12 is securely affixed to the doffer roll 11 by circumferentially spaced clamps 22, 22' mounted on the periphery of the doffer roll 11. Clamps 22, 22' extend radially inward of the doffer 10 through a circumferentially extending slot 40 located in the center of the periphery of the doffer roll 11.

However, the doffer card clothing 12 may be attached to the doffer 10 in a variety of other ways, if desired. For example, instead of clamps 22, 22', cleats may be utilized. Alternatively, the doffer clothing 12 may be affixed to the periphery of the doffer roll 11 by glue or other adhesive of a strength and character to ensure its non-slip attachment to the doffer roll. If desired, the doffer card clothing 12 may be provided in the form of an endless loop or annulus, which may be affixed to the periphery of the doffer roll 11 by any suitable adhesive, or by a two-sided adhesive tape.

To prevent the card clothing 12 from shifting transversely relative to the doffer 10, as a result of the force of the needles N entering the doffer wires 14, an annular flange 50 is affixed to the downstream end of the doffer, i.e. to the end of the doffer from which the needles emerge with fibers in their hooks.

Figure 5:
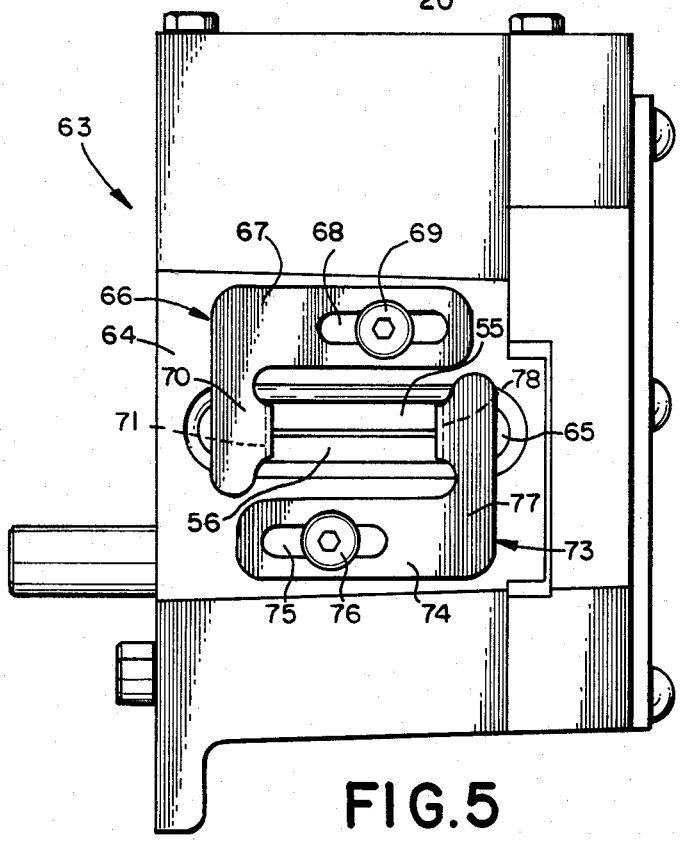
FIG. 5 is an enlarged fragmentary view in front elevation of the feed stand for the carding head of the invention, looking in the direction of the angled arrows 5—5 of FIG. 2 and illustrating the adjustable sliver entrance guides.

FIG. 5 illustrates the preferred guide means of this invention by which the roving or sliver S may be guided to the feed rolls 55, 56 so as to selectively locate and control the fiber transfer path through the fiber feed system 52 constituted of doffer 10, main cylinder 53 and feed rolls 55, 56. The roving guide means is mounted on a conventional sliver feed stand 63 which supports the usual sliver entrance plate 64 provided with a horizontally elongated slot 65 through which the sliver feed rolls 55, 56 draw the sliver S from its source of supply (not shown) for delivery to the main cylinder 53.

The roving or sliver guide means of the invention includes an upper right-angled sliver guide 66 and a lower right-angled sliver guide 73. The upper guide member 66 has a horizontal arm 67 provided with a horizontally elongated slot 68 for reception of a threaded bolt 69 by means of which guide member 66 may be affixed to the sliver entrance plate 64 above its slot 65. Sliver guide member 66 also includes a vertical or depending arm 70 connected integrally to horizontal arm 67. The inner edge of depending arm 70 is provided with a right-angled, horizontal sliver guide finger 71 which extends through the feed stand slot 65 in the direction of the sliver feed rolls 55, 56. Preferably, guide finger 71, at its proximal end, is integral with vertical arm 70, and has its distal end (FIG. 2) terminating close to the nip of the feed rolls 55, 56.

The lower sliver guide member 73 is disposed below the horizontal sliver entrance slot 65, and has a construction identical to that of upper sliver guide 66. Lower guide 73 includes a horizontal arm 74 provided with a horizontally elongated slot 75 through which extends a threaded bolt 76 for affixing guide member 73 to the sliver entrance plate 64. Lower sliver guide 73 further includes a vertical, upwardly extending arm 77 provided with a horizontal sliver guide finger 78 extending through sliver entrance slot 65. The proximal end of sliver guide finger 78 is integral with the inner edge of the vertical arm 77 of the lower guide member 73, and its distal end terminates close to the nip of the sliver feed rolls 55, 56 (FIG. 2).

The two horizontal sliver guide fingers 71, 78 are disposed in spaced parallel relation to each other. They may be adjusted selectively toward or away from each other to selectively locate and control the width of the fiber transfer path through the fiber transfer system or unit 52. Such adjustment is achieved by the cooperative relationship between the upper and lower guide slots 68, 75 and their respective bolts 69, 76. Upon loosening the bolts 69, 76, the slots 68, 75 enable the sliver guide members 66, 73 to be adjusted horizontally relative to the sliver entrance slot 65, whereby the spaced sliver guide fingers 71, 78 may be selectively located relative to each other to control the fiber transfer path, and to permit the sliver S to be guided accurately, as desired, to the feed rolls 55, 56.

Thus, the essential elements of the roving or sliver guide means of the invention are constituted by the two vertically spaced, horizontally adjustable sliver entrance guides 66, 73. Their respective sliver guide fingers 71, 78 function to accurately establish and thereafter maintain a constant fiber path of uniform width through the sliver transfer system 52. This ensures that a continuous film of fibers of selected width and uniform depth and density may be transferred without interruption from the sliver feed rolls 55, 56 via the main cylinder 53 and the doffer 10 to the needles N of the knitting machine 60.

Although a preferred embodiment of this invention has been shown and described herein for the purpose of illustration, as required by Title 35 U.S.C. §112, it is to be understood that various changes, modifications and alterations may be made thereto without departing from the spirit and utility of this invention, or from the scope thereof as set forth in the claims.

We claim:

1. A fiber transfer system for a sliver high pile fabric knitting machine, said system including a doffer, a main cylinder and sliver feeding elements, characterized by a doffer having an axial width less than the axial width of the main cylinder.

2. The fiber transfer system of claim 1, characterized by the doffer having a fiber transfer area substantially coterminus in width with the axial width of the doffer.

3. The fiber transfer system of claim 1, characterized by the main cylinder having a fiber transfer area of a width less than the axial width of the main cylinder, the width of the fiber transfer area of the main cylinder being substantially equal to the axial width of the doffer.

4. The fiber transfer system of claim 1, wherein the main cylinder has a fiber transfer area of a width less than the axial width of the main cylinder and the doffer has a fiber transfer area of a width less than the axial width of the doffer, characterized by said fiber transfer areas of the main cylinder and doffer being of substantially equal width and being aligned to provide a path for transfer of fibers to the knitting machine.

5. The fiber transfer system of claim 1, characterized by (a) a main cylinder having a periphery enveloped by helically wound card clothing and (b) a doffer having a periphery enveloped by straight wound card clothing.

6. The fiber transfer system of claim 5, characterized by (a) main cylinder card clothing composed of a narrow, elongated strip of card clothing having opposite ends affixed to the main cylinder and (b) doffer card clothing composed of an integral, one piece, generally rectangular segment of card clothing having opposite ends disposed in abutting relation on the doffer.

7. The fiber transfer system of claim 1, characterized by (a) a main cylinder having a periphery enveloped by a narrow, elongated strip of helically wound card clothing having opposite ends affixed to the main cylinder and (b) a full width doffer having a periphery enveloped by non-helically wound card clothing.

8. The fiber transfer system of claim 1, characterizied by guide means disposed adjacent the sliver feeding elements for guiding sliver to said elements.

9. A fiber transfer system for feeding a continuous film of sliver fibers to the needles of a sliver knitting machine, said system including a doffer, a main cylinder and a pair of sliver feed rolls, characterized by (a) a doffer having a periphery enveloped by straight wound card clothing to provide a doffer fiber transfer area of substantially constant width, (b) a main cylinder having a periphery enveloped by helically wound card clothing to provide a main cylinder fiber transfer area having a width substantially equal to the width of the doffer fiber transfer area, (c) said doffer and main cylinder fiber transfer areas being aligned with the feed rolls to provide a path for transfer of the film of fibers from the feed rolls to the needles, and (d) adjustable guide means disposed adjacent the feed rolls for directing sliver to said rolls and for controlling the width of the film of fibers.

10. The fiber transfer system of claim 9, characterized by a doffer having a full population of doffer wires.

11. The fiber transfer system of claim 9, characterized by a doffer having an axial width less than the axial width of the main cylinder.

12. The fiber transfer system of claim 11, characterized by the doffer having a fiber transfer area substantially coterminus in width with the axial width of the doffer.

13. The fiber transfer system of claim 9, wherein the sliver feed rolls are interposed between the adjustable guide means and the main cylinder, characterized by the adjustable guide means comprising (a) a pair of uniformly spaced sliver guide fingers having distal ends disposed close to the feed rolls and (b) adjustment means for selectively locating the sliver guide fingers in spaced relation relative to each other.

14. A fiber transfer and feeding unit for delivering liver fibers in the form of a continuous fibrous layer of preselected width to the needles of a sliver high pile fabric circular knitting machine, said unit including a doffer, a main cylinder and at least one pair of sliver feed rolls, characterized by (a) a full width doffer having a periphery enveloped by a non-helical layer of card clothing, (b) a main cylinder having a periphery enveloped by a narrow, elongated strip of helically wound card clothing, (c) said doffer and said main cylinder each having fiber transfer areas aligned with the feed rolls to provide a path for transfer of the layer of fibers from the feed rolls to the needles of the knitting machine, said doffer and main cylinder fiber transfer areas being of uniform and substantially identical width, and (d) adjustable sliver guide means disposed adjacent the feed rolls for directing sliver to said rolls and for adjusting selectively the width of the layer of fibers.

15. The fiber transfer and feeding unit of claim 14, characterized by the doffer having straight wound card clothing with a full population of doffer wires.

16. The fiber transfer and feeding unit of claim 14 wherein the helically wound strip of main cylinder card clothing has opposite ends affixed to spaced edge portions of the main cylinder, characterized by the main cylinder fiber transfer area being located intermediate said spaced edge portions.

17. The fiber transfer and feeding unit of claim 16, characterized by the width of the fiber transfer area of the main cylinder being substantially equal to the axial width of the doffer.

18. The fiber transfer and feeding unit of claim 17, characterized by the fiber transfer area of the doffer being substantially coterminus in width with the axial width of the doffer.

19. The fiber transfer and feeding unit of claim 14, characterized by the adjustable sliver guide means having a pair of uniformly spaced sliver guide fingers disposed close to the sliver feed rolls, said guide fingers being adjustable toward and away from each other to vary selectively the spacing therebetween.

* * * * *